US006069544A

United States Patent [19]

Seymour et al.

[11] Patent Number: 6,069,544

[45] Date of Patent: May 30, 2000

[54] CIRCUIT BREAKER OPERATING MECHANISM HAVING A COLLAPSIBLE CONTACT ARM LINKAGE ASSEMBLY

[75] Inventors: Raymond K. Seymour, Plainville; Thomas Papallo, Farmington, both of Conn.

[73] Assignee: General Electric Company, Schenectady, N.Y.

[21] Appl. No.: 09/176,624

[22] Filed: Oct. 22, 1998

[51] Int. Cl.[7] ..... H01H 3/00

[52] U.S. Cl. ..... 335/185; 200/401; 335/189; 335/191

[58] Field of Search ..... 200/293, 400, 200/401; 335/6, 7, 8, 10, 11, 15, 16, 20, 21, 167, 172, 185, 189, 190, 191, 192, 193, 194

[56] References Cited

U.S. PATENT DOCUMENTS

| | | | |
|---|---|---|---|
| 3,073,936 | 1/1963 | Baird | 200/293 |
| 4,001,742 | 1/1977 | Jencks et al. | 335/173 |
| 4,023,127 | 5/1977 | Mune | 335/172 |
| 4,114,123 | 9/1978 | Grenier | 335/194 X |
| 4,581,181 | 4/1986 | Nicholls | 261/91 |
| 4,801,907 | 1/1989 | Kelaita, Jr. et al. | 335/20 |
| 5,424,701 | 6/1995 | Castonguay et al. | 335/172 |

*Primary Examiner*—J. R. Scott

*Attorney, Agent, or Firm*—Cantor Colburn LLP; Damian G. Wasserbauer; Carl B. Horton

[57] ABSTRACT

A collapsible contact arm drive link arrangement for a circuit breaker operating mechanism has a pair of upper links for receiving the circuit breaker operating mechanism and a lower link for receiving a circuit breaker contact arm carrier at one end. Intermediate the upper links and the lower link, a scissors link, which is connected with the upper links and lower link, allows the lower link to move from a first position (e.g., closed) to a second position (e.g., tripped). The movement occurs upon the application of a force on the lower link in excess of a predetermined force that is applied to the upper links.

18 Claims, 6 Drawing Sheets

(CLOSED)

(TRIPPED)

CIRCUIT BREAKER OPERATING MECHANISM HAVING A COLLAPSIBLE CONTACT ARM LINKAGE ASSEMBLY

FIELD OF INVENTION

The present invention relates to a high ampere-rated circuit breaker operating mechanism that is connected to the movable contact arms within each one of the circuit breaker poles by means of a collapsible linkage. The linkage remains intact under both quiescent and ordinary overcurrent conditions while collapsing to allow contact separation upon occurrence of a short-circuit overcurrent condition within any one of the poles.

BACKGROUND OF THE INVENTION

U.S. Pat. No. 4,001,742 entitled "Circuit Breaker Having Improved Operating Mechanism" describes a circuit breaker capable of interrupting several thousand amperes of circuit current at several hundred volts potential. As described therein, the operating mechanism is in the form of a pair of powerful operating springs that are restrained from separating the circuit breaker contacts by means of a latching system. Once the operating mechanism has responded to separate the contacts, the operating springs must be recharged to supply sufficient motive force to the movable contact arms that carry the contacts.

U.S. Pat. No. 5,424,701 entitled "Operating Mechanism for High Ampere-Related Circuit Breaker describes an operating mechanism capable of immediately resetting the circuit breaker operating mechanism to reclose the contacts without having to recharge the circuit breaker operating springs immediately after opening the circuit breaker contacts.

When such circuit breakers are exposed to short circuit overcurrent conditions, the powerful magnetic forces of repulsion generated between the moveable and fixed contacts within any one of the circuit breaker poles, overcomes the holding forces of the contact springs and "blows" the moveable contact to the contact OPEN condition.

The circuit breaker operating mechanism, that controls the ON and OFF states of the circuit breaker contacts is designed for a particular circuit breaker ampere rating. If one such operating mechanism is used within higher than rated circuit breaker applications, it has been determined that the contacts may "blow open" upon overcurrent occurrence that is lower than short circuit.

It would be economically advantageous to be able to use a common circuit breaker operating mechanism over a wide range of circuit breaker ratings without having to adjust the circuit breaker holding springs to compensate for higher ampere ratings.

The purpose of this invention is to provide a mechanical linkage arrangement between the circuit breaker operating mechanism and the movable contact arms. The linkage being capable of retaining the circuit breaker movable contact arms from separating the circuit breaker contacts during quiescent current conditions while insuring rapid contact separation upon the occurrence of a short circuit overcurrent condition.

SUMMARY OF THE INVENTION

The circuit breaker operating mechanism linkage between the circuit breaker movable contact arms and the operating mechanism is calibrated to release the movable contact arm within each of the poles during short circuit overcurrent conditions while restraining the movable contact arm under ordinary overcurrent conditions. The linkage includes a scissors link and a pair of rollers defined to release upon occurrence of a mechanical force in excess of one thousand pounds.

DESCRIPTION OF THE PREFERRED EMBODIMENT

Figure 1:
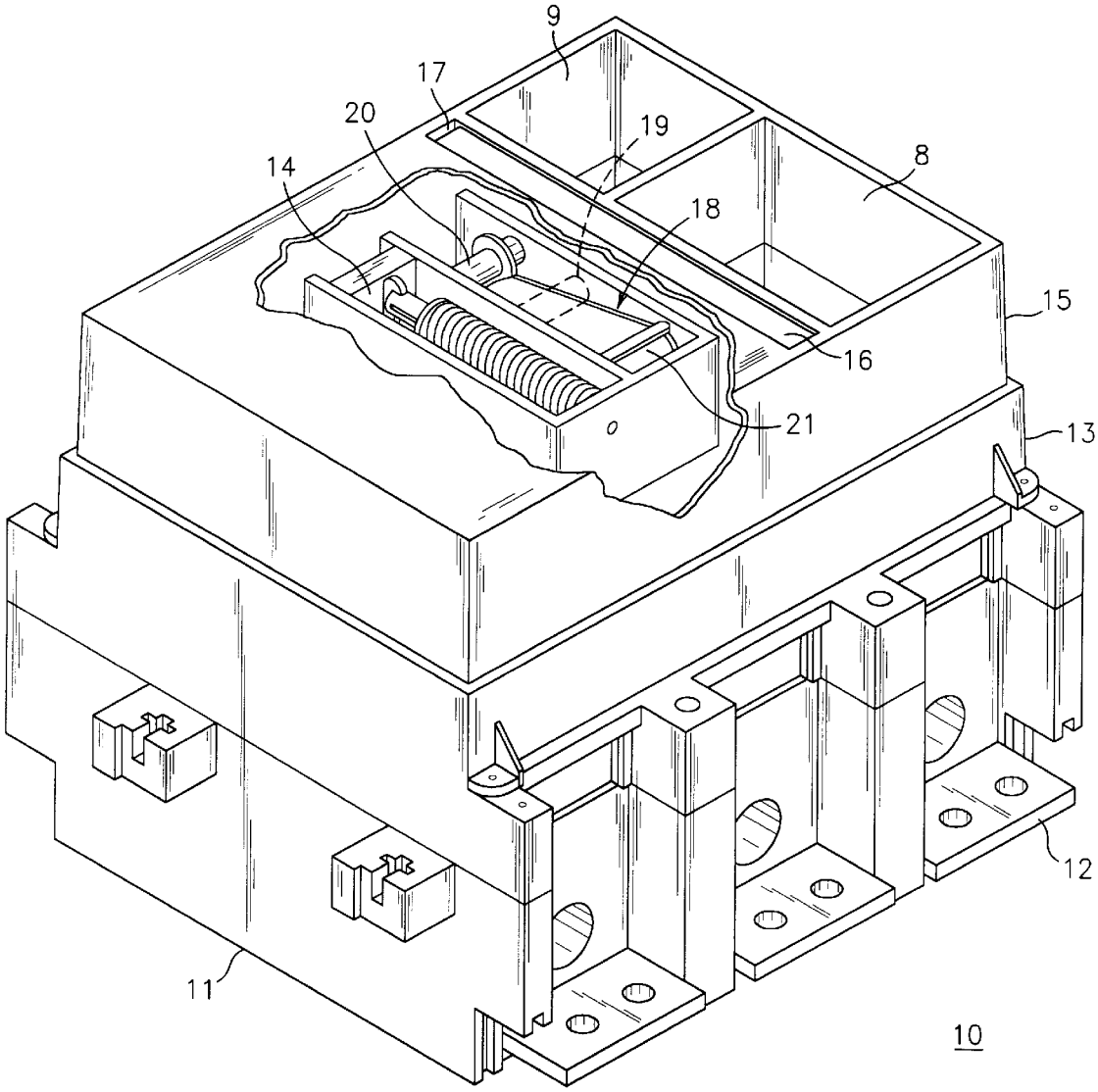
FIG. 1 is a top perspective view of a high ampere-rated circuit breaker with a portion of the circuit breaker cover removed to depict the location of the operating mechanism relative to the contact arm collapsible linkage assembly according to the invention.

The high ampere-rated circuit breaker 10 shown in FIG. 1 is capable of transferring several thousand amperes quiescent circuit current at several hundred volts potential without overheating. The circuit breaker consists of an electrically insulated base 11 to which an intermediate cover 13 of similar insulative material is attached prior to attaching the top cover 15, also consisting of an electrically-insulative material. Electrical connection with the interior current carrying components is made by load terminal straps 12 extending from one side of the base and line terminal straps (not shown) extending from the opposite side thereof. The interior components are controlled by an electronic trip unit contained within a recess 8 on the top surface of the top cover 15. Although not shown herein, the trip unit is similar to that described within U.S. Pat. No. 4,581,181 and interacts further with an accessory contained within the accessory recess 9 to provide a range of protection and control functions such as described, for example within U.S. Pat. No. 4,801,907. The operating mechanism 18 includes a drive shaft 19 and a closing shaft 20 which interact with a latching system 21 to control the spring forces exerted by the closing spring modular unit 14 which is described in greater detail within the aforementioned U.S. Pat. No. 5,424,701.

Figure 2:
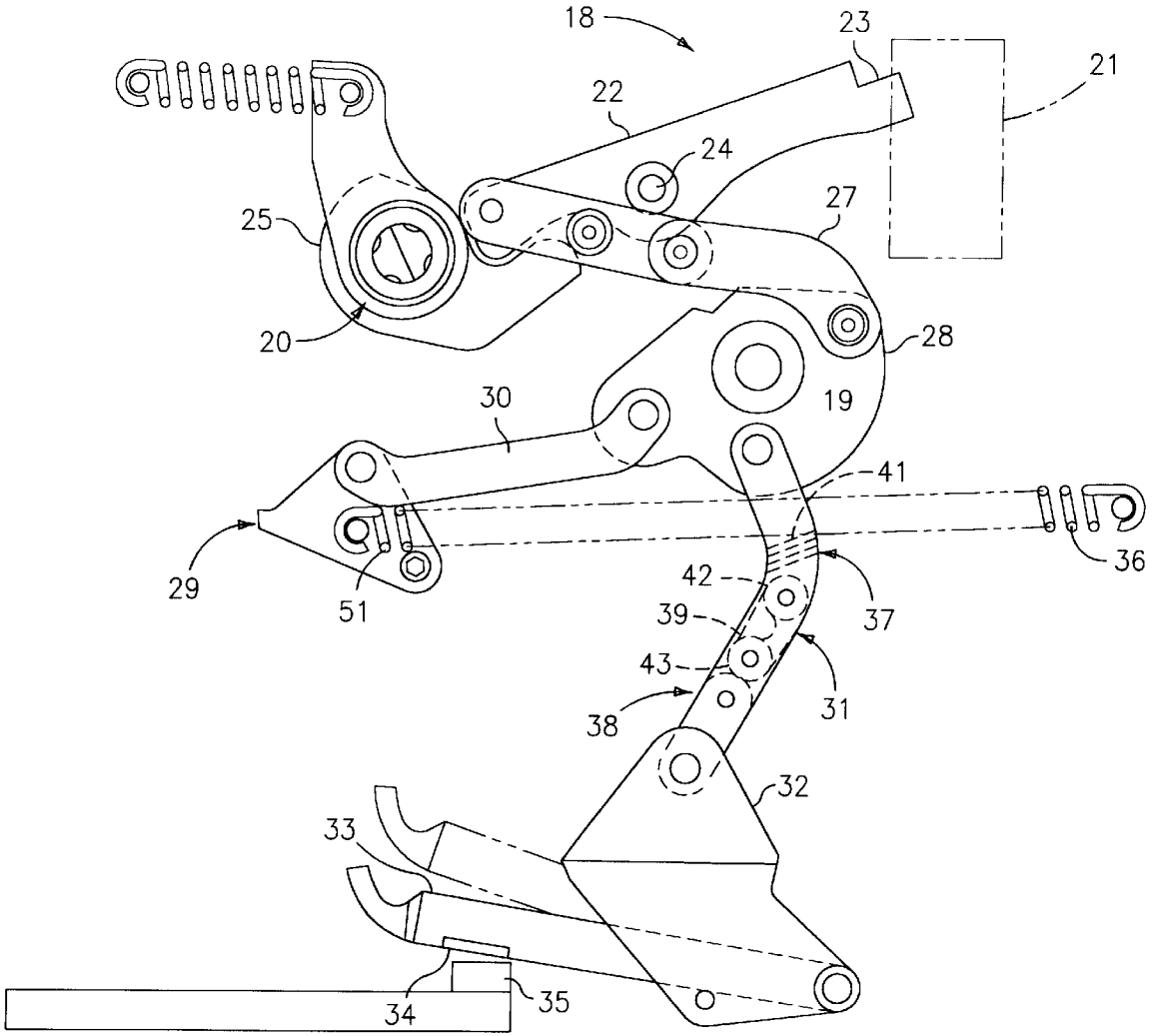
FIG. 2 is an enlarged side view of the operating mechanism, collapsible linkage assembly and contacts used within the circuit breaker of FIG. 1.

The operating handle 16 located within the handle recess 17 allows manual operation of the circuit breaker operating mechanism 18 to separate the circuit breaker movable and fixed contacts 34, 35 as best seen by now referring to the circuit breaker 10 shown in FIG. 2.

As described within the aforementioned U.S. Pat. No. 5,424,701 the operating mechanism 18 includes a cradle 22 that is supported on the cradle pivot 24 and interacts with the closing shaft 20 by means of the cradle link 25 and the closing link 27. The cradle hook 23 is retained by the latch assembly 21 to prevent the cradle 22 from rotating about the cradle pivot 24 allowing the powerful operating springs 36 to rotate the crank 28 on the drive shaft 19 and lift the contact arm collapsible drive link 31, contact arm carrier 32 and contact arm 33 from the CLOSED condition as depicted in FIG. 2 to the TRIPPED condition with the movable contact 34 moved away from the fixed contact 35, as indicated in phantom. The interface cam 29 connects with the crank 28, interface link 30 and drive shaft 19 to assist in moving the contacts to their TRIPPED condition. In accordance with the teachings of the invention, the collapsible contact arm drive link 31, hereinafter "collapsible link" includes a pair of top links 37 connecting with a bottom link 38 by means of a scissors (drive) link 39, compression spring 41 and first and second rollers 42, 43.

Figure 3:
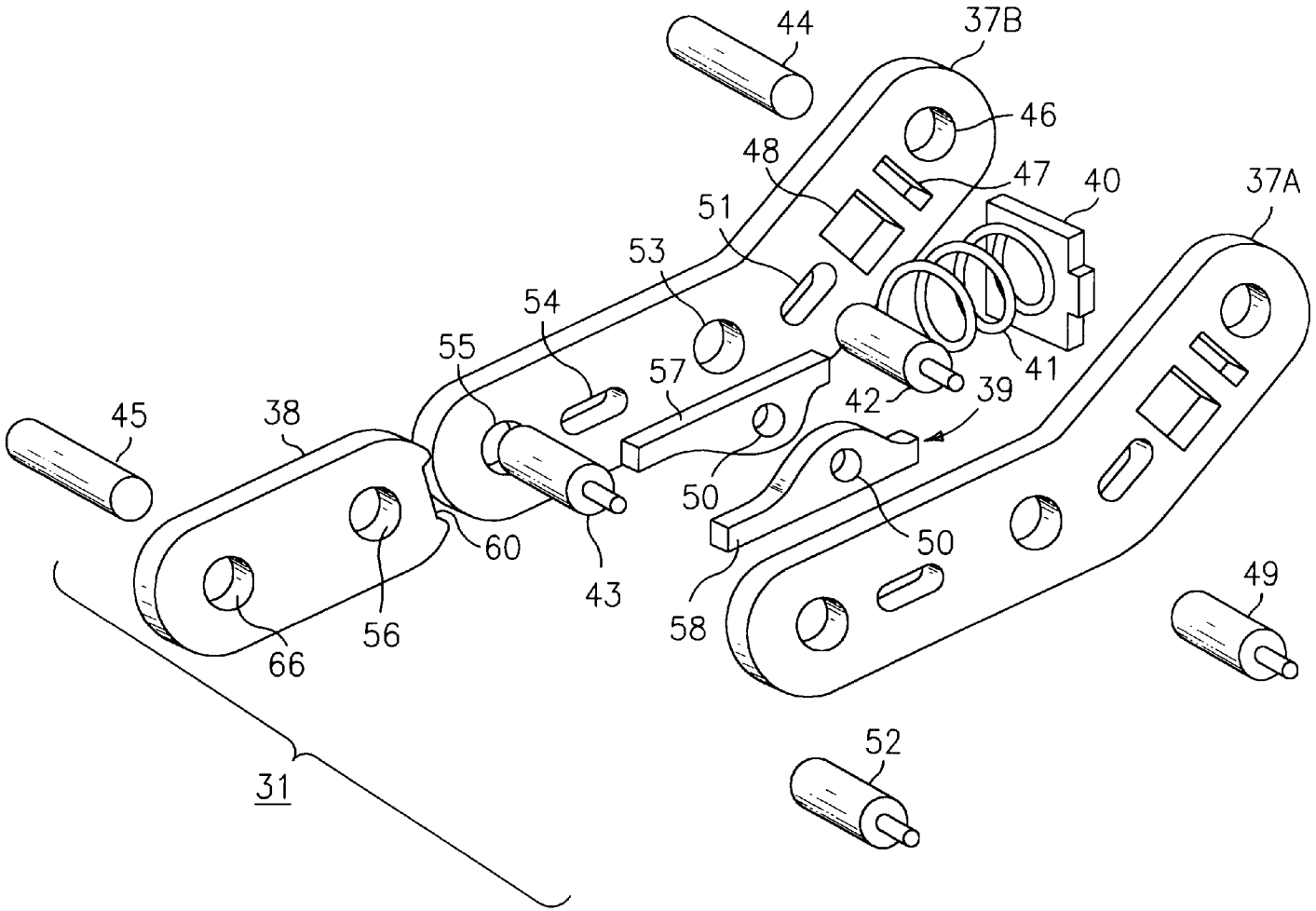
FIG. 3 is an enlarged top perspective view of the collapsible linkage assembly of FIG. 2 with the components in isometric projection.

The collapsible link 31 is depicted in FIG. 3 prior to assembly as follows. The pair upper links 37A, 37B contain the compression spring 41 which is supported on a back plate 40 and the back plate is assembled to the upper links 37A, 37B by means of a pair of opposing slots, one of which is shown at 47. The first roller 42 interfaces on end of the compression spring 41 and one end of the scissors link 39 while the second roller 43 interfaces the other end of the scissors link and U-shaped slot 60 on the end of the bottom link 38. The first roller 42 is attached to the upper links 37A, 37B by means of a pair of slotted apertures, one of which is shown at 51, the scissors link 39 is attached to the upper links 37A, 37B by means of a pivot pin 49 that passes through the scissors link apertures 50 and through a pair of opposing apertures on the upper links 37A, 37B, one of which is shown at 53. The second roller 43 is attached to the upper links 37A, 37B by means of a pair of slotted apertures, one of which is shown at 54 and the bottom link 38 is attached to the upper links by means of the pivot 52, a pair of opposing apertures, one of which is shown at 55 and by means of aperture 56. The upper links 37A, 37B are attached to each other and to the crank 28 of FIG. 2 by means of the pin 44. The bottom link 38 is attached to the contact arm carrier 32 of FIG. 2 by means of the pin 45 and aperture 66.

Figure 4:
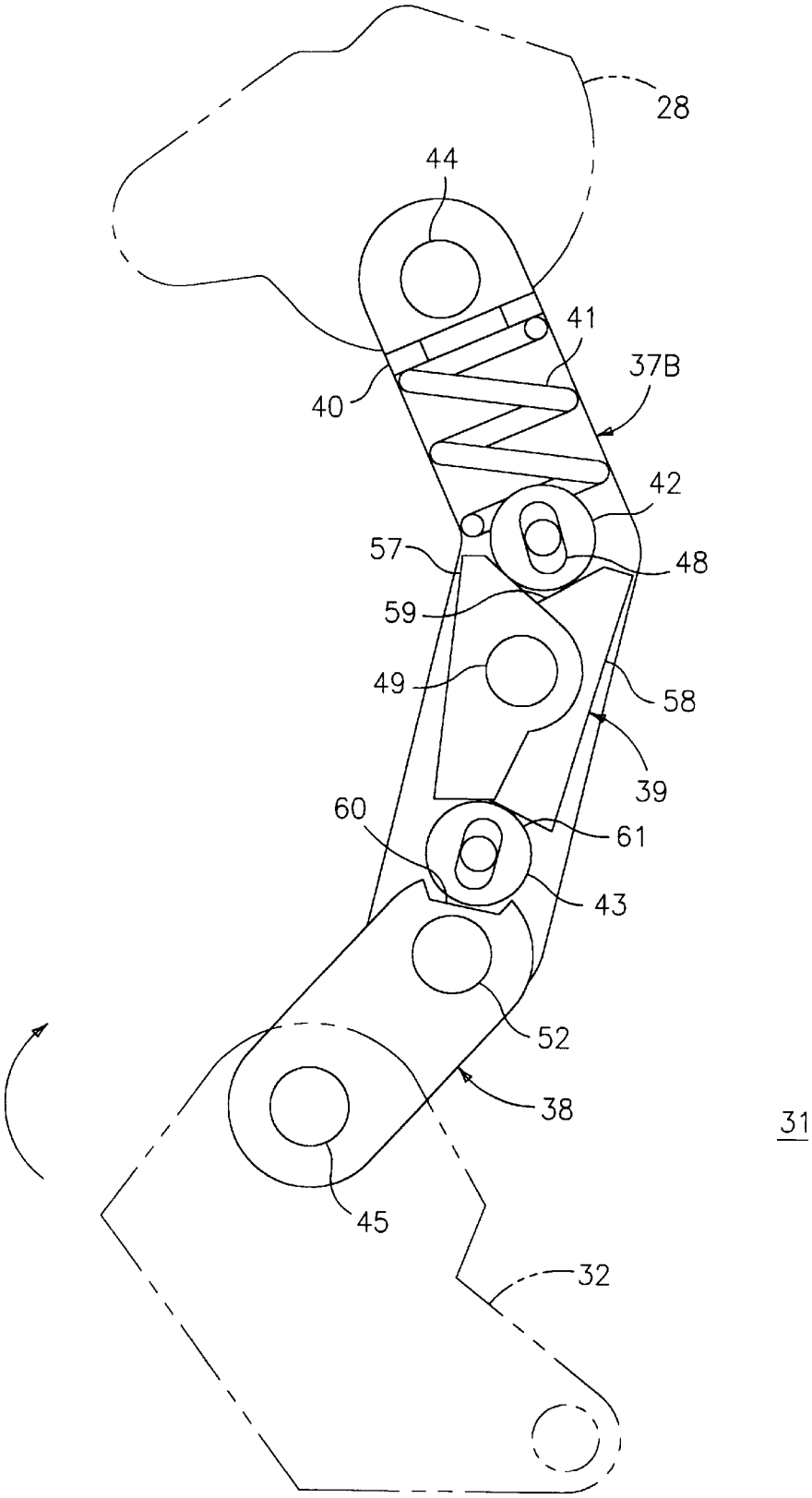
FIG. 4 is an enlarged side view of the collapsible linkage assembly used within the circuit breaker of FIG. 1 under quiescent and ordinary overcurrent conditions.
Figure 5:
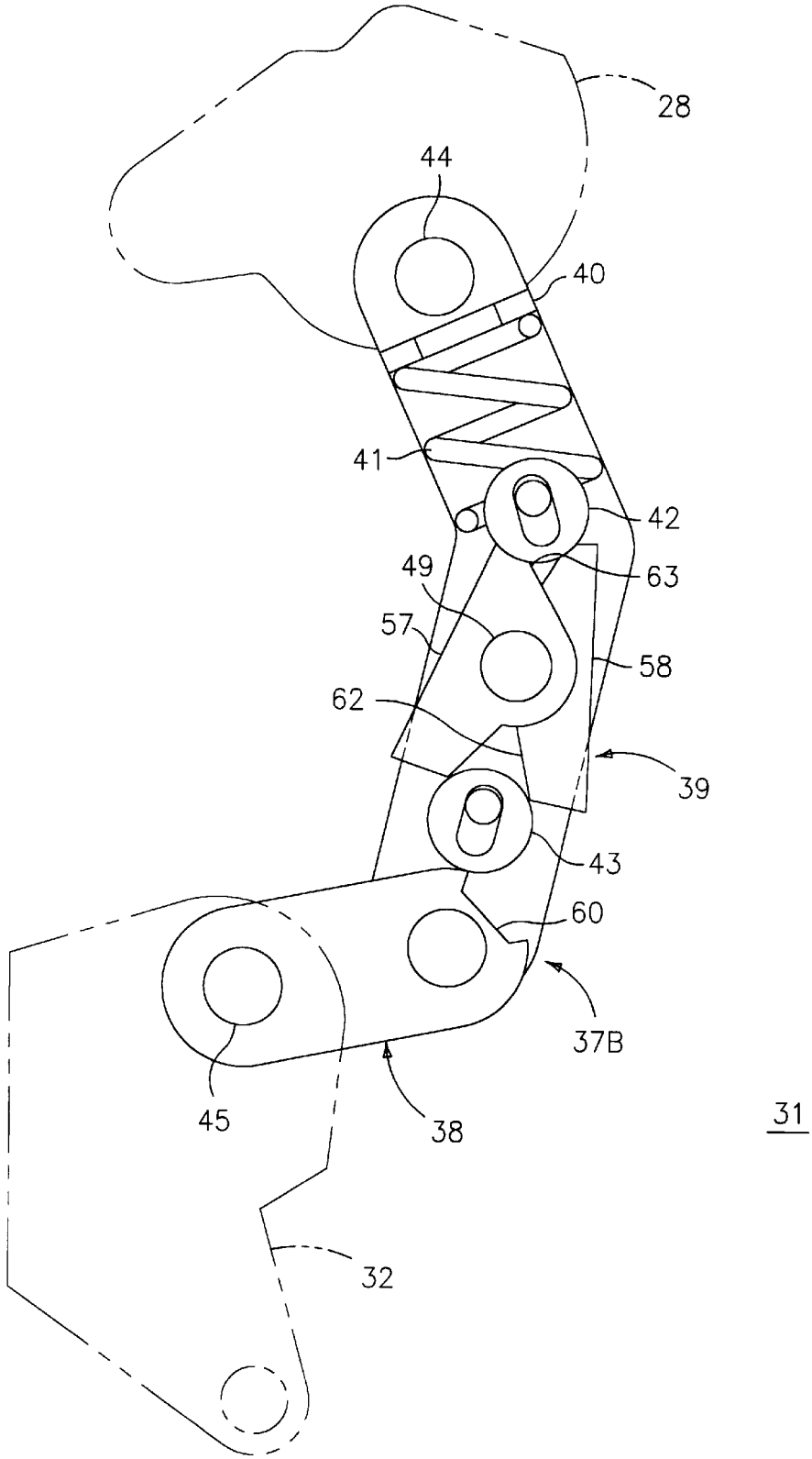
FIG. 5 is an enlarged side view of the collapsible linkage assembly used within the circuit breaker of FIG. 1 under short circuit overcurrent conditions.

The operation of the collapsible link 31 is best seen by now referring to FIGS. 4 and 5.

In FIG. 4, the contacts 34, 35 of FIG. 2 remain in the closed condition with the collapsible link 31 extending intact between the crank 28 by means of pin 44 and the contact arm carrier 32 by means of pin 45. The upper link 37A is removed to depict the arrangement of the components along the upper link 37B to which the lower link 38 is attached by means of pin 52. The second roller 43 is captured within the U-shaped slot 60 on the end of the bottom link 38 at one end, and abuts against the radial surface 61 defined by the bottom of the links 57, 58 on the scissors link 39 at the opposite end thereof. The first roller 42 is captured within the V-shaped slot 59 defined by the top of the links 57, 58 on the scissors link 39 at one end and abuts against one end of the compression spring 41 at the opposite end thereof. The collapsible link 31 remains intact while the force exerted thereon by means of the contact arm carrier 32 through the bottom link 38, pin 52, second roller 43, scissors link pivot 49, first roller 42, compression spring 41, and pin 44 is less than the force provided by the compression spring 41. In this embodiment, the collapsible link 31 remains intact until a force in excess of one thousand pounds is exerted by the contact arm carrier 32 in the indicated direction. Should a short circuit condition occur within a protected circuit containing the circuit breaker 10 of FIG. 1, the blow-open forces exerted on the contact arm carrier would exceed one thousand pounds causing the collapsible link 31 to assume the TRIPPED condition best seen by now referring to FIG. 5 wherein the contacts 34, 35 of FIG. 2 become separated. The bottom link 38 rotates clockwise to release the second roller 43 from the U-shaped slot 60 thereby driving the second roller against the bottom of the links 57, 58 on the scissors link 39 to form a V-shaped slot 62 at the bottom thereof, and a radial slot 63 at the top thereof forcing the first roller 42 against the compression spring 41 and moving the end plate 40 against the top pin 44. Upon resetting of the circuit breaker operating mechanism 18 of FIG. 1, the collapsible link 31 returns to the CLOSED position indicated earlier in FIG. 4.

Figure 6:
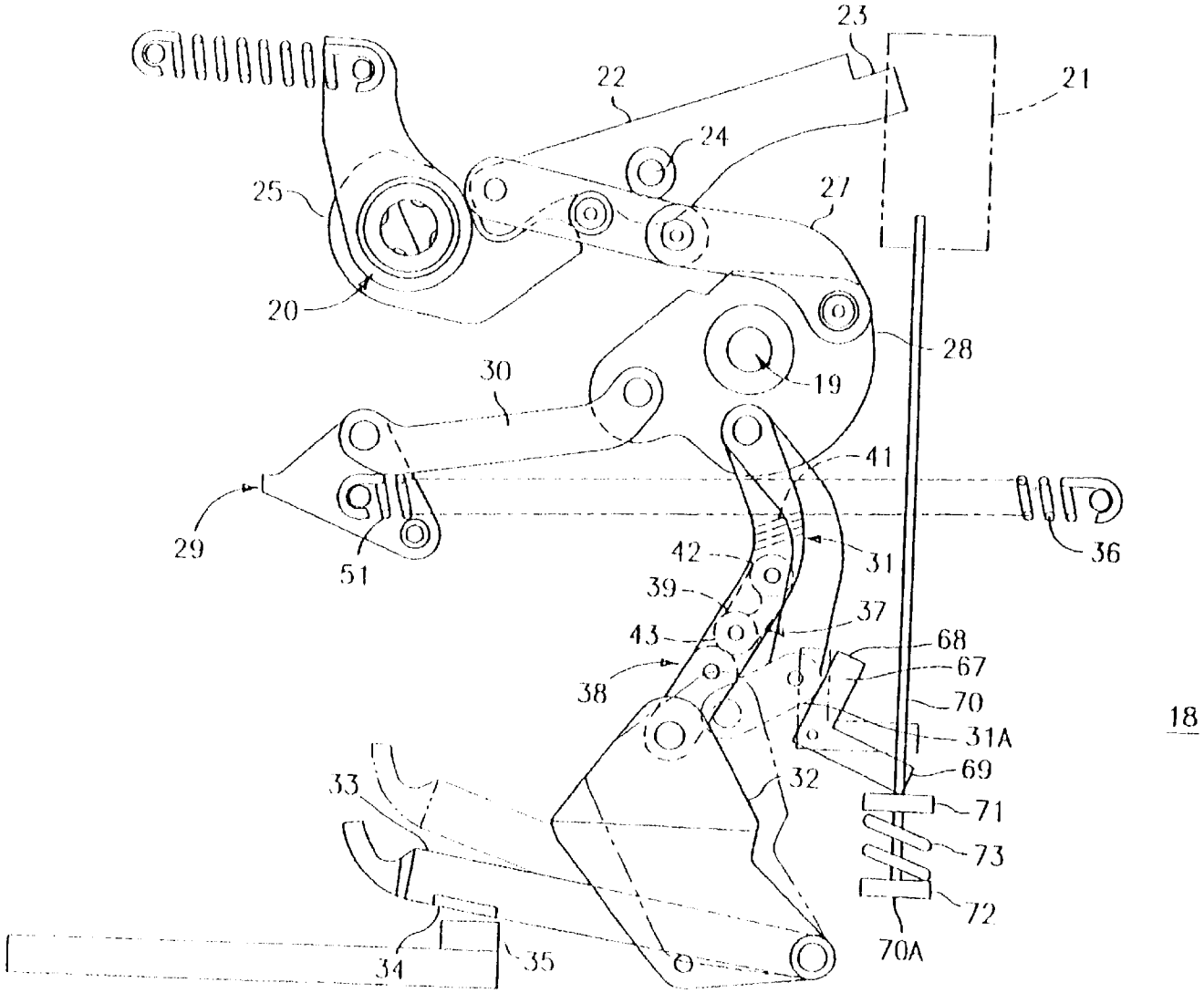
FIG. 6 is an enlarged side view of the operating mechanism, collapsible linkage assembly and contacts of FIG. 2 including the trip rod that interconnects between the individual poles within the circuit breaker of FIG. 1.

In order to prevent so-called "single phasing" whereby the circuit current may transfer within a single pole of a multipole circuit breaker after interruption of another pole, the arrangement depicted in FIG. 6 is employed. To insure that the remaining poles become interrupted simultaneously, a trip rod 70 interacts with the operating mechanism latch assembly 21 in the following manner. When the contacts 34, 35 are closed, as indicated in solid lines, collapsible drive link 31 is away from the trip bar 67 having a first lever 68 at one end for interacting with the knee of the drive link as indicated at 31A and a second lever 69 for interacting with a first nut 71 connecting with the threaded end of the trip rod 70 as indicated at 70A, a second nut 72 is connected with the threaded end of the trip rod with a compression spring 73 captured between the first and second nuts 71 and 72 to provide for tolerance compensation. As further indicated in phantom, the knee of the drive link contacts the first lever 68 of the trip bar 67 rotating the second lever 69 and the first assembly nut 71 in the downwards clockwise direction to displace the trip rod 70 and latch 21 thereby causing the operating mechanism to separate the associated contacts within the remaining poles in the manner described within the aforementioned U.S. Pat. No. 3,073,936.

A collapsible link as part of a high ampere-rated circuit breaker operating mechanism has herein been described. The withstand force of the collapsible link is adjusted to allow the link to remain intact until a magnetic repulsion force generated by the circuit breaker contacts upon short-circuit overcorrect conditions is exceeded. At this point, the link collapses to reduce the amount of mechanical force reflected back upon the circuit breaker operating mechanism while allowing the contacts within the associated pole to become separated and interrupt circuit current through the associated pole. A trip rod and trip bar arrangement has also been disclosed for preventing single phase operation upon contact separation within any of the circuit breaker poles.

Although the present invention has been described with reference to certain embodiments, it will be appreciated that these embodiments are not limitations and that the scope of the invention is defined by the following claims.

We claim:

1. A collapsible contact arm drive link arrangement for a circuit breaker operating mechanism, comprising:

a pair of upper links for receiving said circuit breaker operating mechanism;

a lower link for receiving a circuit breaker contact arm carrier at one end; and a scissors link intermediate said upper links and said lower link, wherein said scissors link is connected with said upper links and said lower link, to allow said lower link to move from a first position to a second position upon application of a force upon said lower link in excess of a predetermined value.

2. The collapsible link arrangement of claim 1 further including a first roller in contact with one end of said scissors link and a top portion of said upper links, and a second roller in contact with an opposite end of said scissors link, a lower portion of said upper links, and said lower link.

3. The collapsible link arrangement of claim 2 wherein said scissors link comprises a pair of first and second links pivotally attached together.

4. The collapsible link arrangement of claim 3 wherein said first and second rollers are moveably attached between said pair of upper links.

5. The collapsible link arrangement of claim 1 wherein said lower link defines a U-shaped slot at an end of said lower link opposite said one end.

6. The collapsible link arrangement of claim 2 further including a compression spring intermediate said first roller and a first pivot attaching said pair of upper links to a circuit breaker operating mechanism.

7. The collapsible link arrangement of claim 6 wherein said compression spring determines said predetermined force.

8. A circuit breaker for high level over-current protection, comprising:

an insulative base;

a pair of separable contacts within said base, one of said contacts being attached to a movable contact arm;

a contact arm carrier connecting said movable contact arm within said base with a contact arm drive link extending outside said base;

an insulative cover above said base, said cover for enclosing an operating mechanism for thereby moving said contact arm carrier and said contact arm between open and closed positions;

a collapsible drive link connecting between said contact arm and said operating mechanism, said drive link including a pair of upper links for receiving a circuit breaker operating mechanism;

a lower link for receiving a circuit breaker contact arm carrier at one end; and a scissors link intermediate said upper links and said lower link, wherein said scissors link is in connected with said upper links and said lower link, to allow said lower link to move from a first position to a second position upon application of a force upon said lower link in excess of a predetermined value.

9. The circuit breaker of claim 8 further including a first roller in contact with one end of said scissors link and a top portion of said upper links, and a second roller in contact with an opposite end of said scissors link, a lower portion of said upper links, and said lower link.

10. The circuit breaker of claim 9 wherein said scissors link comprises a pair of first and second links pivotally attached together.

11. The circuit breaker of claim 10 wherein said first and second rollers are moveably attached between said pair of upper links.

12. The circuit breaker of claim 11 wherein said lower link defines a U-shaped slot at an end of said lower link opposite said one end.

13. The circuit breaker of claim 12 further including a compression spring intermediate said first roller and a first pivot attaching said pair of upper links to a circuit breaker operating mechanism.

14. The circuit breaker of claim 13 wherein said compression spring determines said predetermined force.

15. A collapsible contact arm drive link arrangement for a circuit breaker operating mechanism of a multi-pole circuit breaker, said collapsible contact arm drive link arrangement, comprising:

a pair of upper links for receiving said operating mechanism;

a lower link for receiving a circuit breaker contact arm carrier within one pole of said multi-pole circuit breaker;

a drive link intermediate said upper links and said lower link to allow said lower link to move from a first position to a second position upon application of a force upon said lower link in excess of a predetermined value; and a trip rod connecting with a latch assembly, said latch assembly interacting with another contact arm carrier within another pole of said multi-pole circuit breaker, whereby said other contact arm carrier within said other pole rotates to an open position when said contact arm carrier within said one pole rotates to an open position.

16. The collapsible contact arm drive link arrangement of claim 15 including a trip lever at one end of said trip rod, said trip lever arranged for interacting between a drive link and said trip rod.

17. The collapsible contact arm drive link arrangement of claim 16 further including a pair of first and second nuts connecting with one end of said trip rod and a compression spring intermediate said first and second nuts for tolerance adjustment between said drive link and said trip rod.

18. The collapsible contact arm drive link arrangement of claim 17 wherein said trip bar includes a first lever arranged for contact with said drive link and a second lever arranged for contact with said first nut.

* * * * *